US009737188B2

(12) United States Patent
Jang et al.

(10) Patent No.: US 9,737,188 B2
(45) Date of Patent: Aug. 22, 2017

(54) METHOD OF CONTROLLING AUTOMATIC CLEANER

(71) Applicant: LG ELECTRONICS INC., Seoul (KR)

(72) Inventors: Jaewon Jang, Seoul (KR); Joonsik Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 108 days.

(21) Appl. No.: 13/861,202

(22) Filed: Apr. 11, 2013

(65) Prior Publication Data

US 2014/0109935 A1 Apr. 24, 2014

(30) Foreign Application Priority Data

Oct. 18, 2012 (KR) ..... 10-2012-0115951

(51) Int. Cl.

| | |
|---|---|
| ***B08B 7/04*** | (2006.01) |
| ***A47L 11/40*** | (2006.01) |
| ***A47L 9/04*** | (2006.01) |
| ***A47L 9/28*** | (2006.01) |
| *B08B 1/00* | (2006.01) |
| *A47L 11/24* | (2006.01) |

(52) U.S. Cl.

CPC ..... *A47L 11/4011* (2013.01); *A47L 9/0472* (2013.01); *A47L 9/0488* (2013.01); *A47L 9/281* (2013.01); *A47L 9/2826* (2013.01); *A47L 9/2847* (2013.01); *A47L 11/4061* (2013.01); *A47L 11/24* (2013.01); *A47L 2201/00* (2013.01); *A47L 2201/04* (2013.01); *A47L 2201/06* (2013.01); *B08B 1/00* (2013.01); *B08B 1/002* (2013.01)

(58) Field of Classification Search

CPC ..... A47L 2201/00; A47L 2201/06; A47L 2201/04; A47L 11/24; B08B 1/00; B08B 1/002

USPC ..... 134/18, 21, 42; 15/41.1, 42, 49.1, 98, 15/319, 340.1, 340.4

See application file for complete search history.

(56) References Cited

U.S. PATENT DOCUMENTS

| | | | | |
|---|---|---|---|---|
| 5,720,077 | A | 2/1998 | Nakamura et al. | |
| 2004/0187249 | A1 | 9/2004 | Jones et al. | |
| 2006/0010638 | A1 | 1/2006 | Shimizu et al. | |
| 2007/0234492 | A1* | 10/2007 | Svendsen et al. | 15/21.1 |
| 2011/0226282 | A1* | 9/2011 | Choi | A47L 9/009 134/18 |
| 2012/0032557 | A1* | 2/2012 | Furuta et al. | 310/317 |
| 2012/0125363 | A1* | 5/2012 | Kim et al. | 134/6 |

(Continued)

FOREIGN PATENT DOCUMENTS

| | | | |
|---|---|---|---|
| EP | 2433541 | A1 | 3/2012 |
| JP | 04-328607 | A | 11/1992 |

(Continued)

*Primary Examiner* — Bibi Carrillo

(74) *Attorney, Agent, or Firm* — Dentons US LLP

(57) ABSTRACT

A method of controlling an automatic cleaner in which the automatic cleaner is moved with a side brush assembly in a first operation type, a corner is determined during the movement of the automatic cleaner, the first operation type of the side brush assembly is changed to a second operation type to clean the corner when the corner is determined, whether the corner is cleaned is determined, and the second operation type of the side brush assembly is returned to the first operation type when the corner is cleaned.

11 Claims, 7 Drawing Sheets

(56) References Cited

U.S. PATENT DOCUMENTS

| | | | | |
|---|---|---|---|---|
| 2012/0169497 | A1 | 7/2012 | Schnittman et al. | |
| 2012/0222224 | A1* | 9/2012 | Yoon et al. | 15/52.1 |
| 2013/0086760 | A1* | 4/2013 | Han | A47L 11/24 15/49.1 |
| 2013/0263889 | A1* | 10/2013 | Yoon et al. | 134/6 |
| 2014/0067116 | A1* | 3/2014 | Moon | A47L 9/2873 700/245 |
| 2014/0124004 | A1* | 5/2014 | Rosenstein et al. | 134/18 |
| 2014/0182627 | A1* | 7/2014 | Williams et al. | 134/21 |

FOREIGN PATENT DOCUMENTS

| | | | |
|---|---|---|---|
| KR | 10-2007-0107956 | A | 11/2007 |
| WO | WO2013/042975 | * | 3/2013 |
| WO | 2013051843 | A1 | 4/2013 |

* cited by examiner

METHOD OF CONTROLLING AUTOMATIC CLEANER

CROSS-REFERENCE TO RELATED APPLICATIONS

The present application claims priority under 35 U.S.C. 119 and 35 U.S.C. 365 to Korean Patent Application No. 10-2012-0115951 (filed on Oct. 18, 2012), which is hereby incorporated by reference in its entirety.

BACKGROUND

The present disclosure relates to a method of controlling an automatic cleaner.

Cleaners may suction and remove a foreign substance from a cleaning surface. Recently, automatic cleaners have been introduced for performing a cleaning operation automatically. Automatic cleaners are moved by the driving force of a motor powered by a battery, to suction and remove a foreign substance from a floor or other target surface.

Generally, a moving device is installed on a casing defining an appearance of an automatic cleaner. The moving device moves the automatic cleaner in a predetermined direction to suction a foreign substance from a floor. To this end, a suction port is disposed in the bottom of the casing to suction a foreign substance from a floor. A main brush, which directly contacts a foreign substance to suction the foreign substance through the suction port, may be disposed within the suction port.

However, the automatic cleaner suctions only a foreign substance located in a region underneath the casing, specifically, underneath the suction port. Thus, it may be difficult to effectively clean a region outside the footprint of the suction port.

To address this issue, a side brush may be disposed on the bottom of the casing. At least one portion of the side brush extends outside the footprint of the casing.

The side brush rotates relative to the casing to move a foreign substance located outside the footprint of the casing, specifically, outside the footprint of the suction port, toward the suction port.

However, such automatic cleaners have the following limitations.

As described above, since a foreign substance located outside the footprint of the suction port can be suctioned through the suction port by means of rotation of the side brush, as the length of the side brush is increased, a cleaning area of the automatic cleaner is substantially increased. However, when the length of the side brush is increased, the side brush may be damaged while the automatic cleaner is in a cleaning operation or is stored. In addition, when the length of the side brush is increased, the automatic cleaner requires a large storage space. Thus, it may be inconvenient to store the automatic cleaner.

SUMMARY

Embodiments provide a method of controlling an automatic cleaner adapted for effectively cleaning a corner.

In one embodiment, a method of controlling an automatic cleaner includes: moving the automatic cleaner with a side brush assembly in a first operation type; determining a corner during the movement of the automatic cleaner based on a signal from an obstacle sensor; changing the first operation type of the side brush assembly to a second operation type to clean the corner when the corner is sensed; determining whether the corner is cleaned; and returning the second operation type of the side brush assembly to the first operation type when the corner is cleaned.

In another embodiment, a method of controlling an automatic cleaner includes: moving the automatic cleaner with a side brush assembly in a general mode; determining a corner during the movement of the automatic cleaner based on a signal from an obstacle sensor; operating a side brush assembly in a corner cleaning mode when the corner is sensed, wherein the side brush assembly includes: a movable member movably provided on the automatic cleaner; and a brush rotatably connected to the movable member, wherein the movable member is in a first operation type in the general mode, and is changed to a second operation type in the corner cleaning mode.

The details of one or more embodiments are set forth in the accompanying drawings and the description below. Other features will be apparent from the description and drawings, and from the claims.

DETAILED DESCRIPTION OF THE EMBODIMENTS

Hereinafter, exemplary embodiments will be described with reference to the accompanying drawings.

Figure 1:
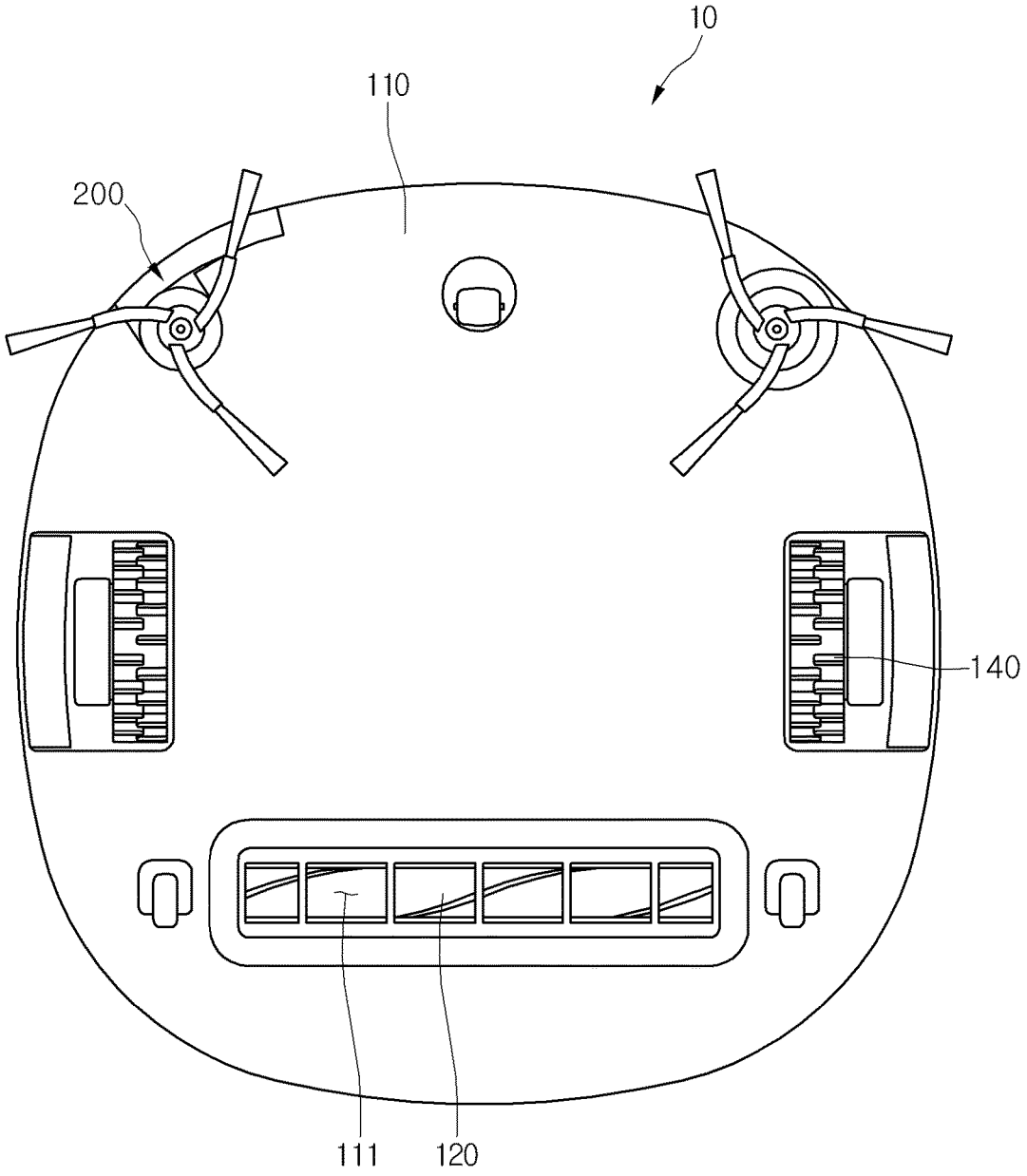
FIG. 1 is a bottom view illustrating an automatic cleaner according to a first embodiment.
Figure 2:
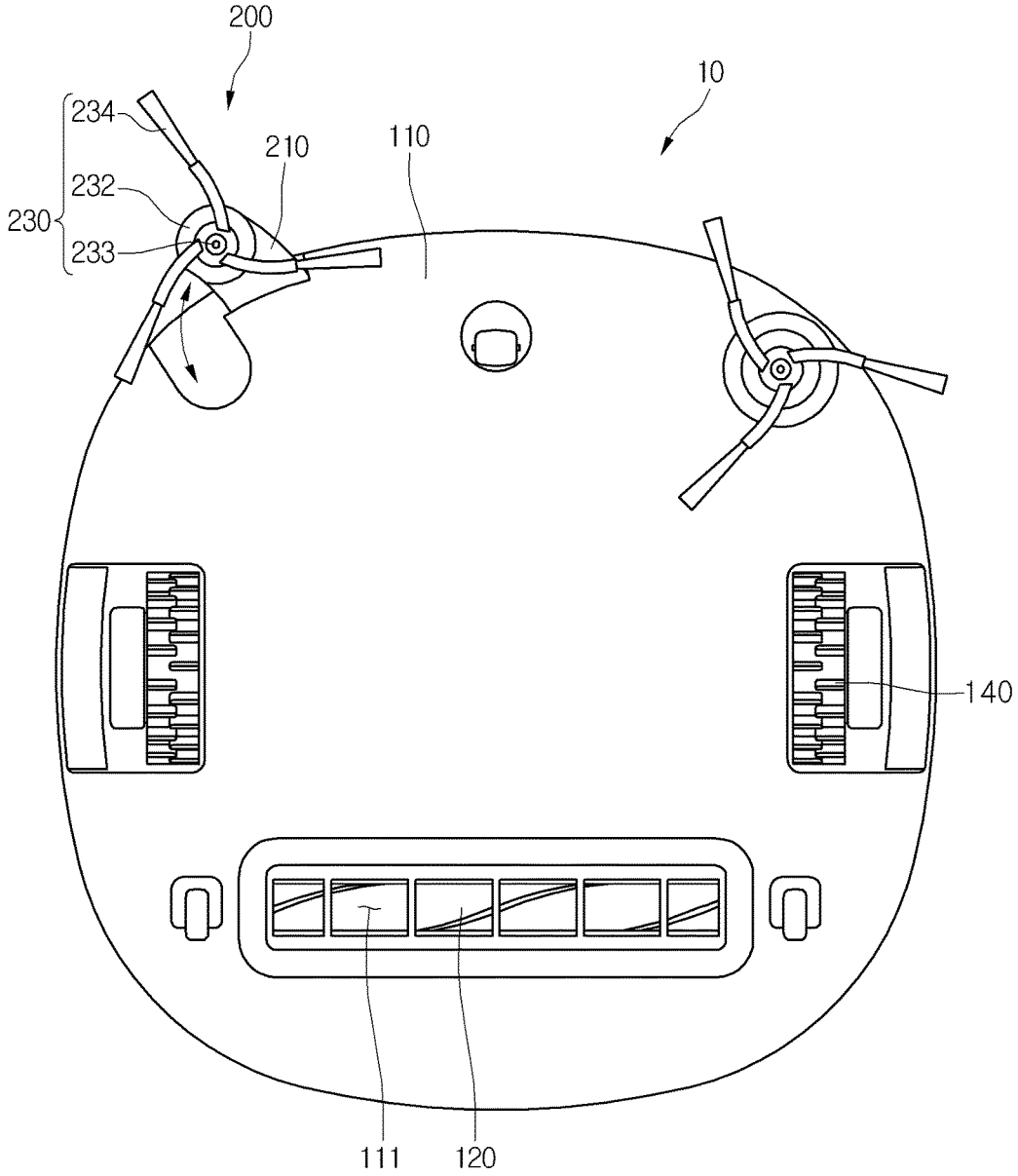
FIG. 2 is a bottom view illustrating an operation of a side brush assembly according to the first embodiment.
Figure 3:
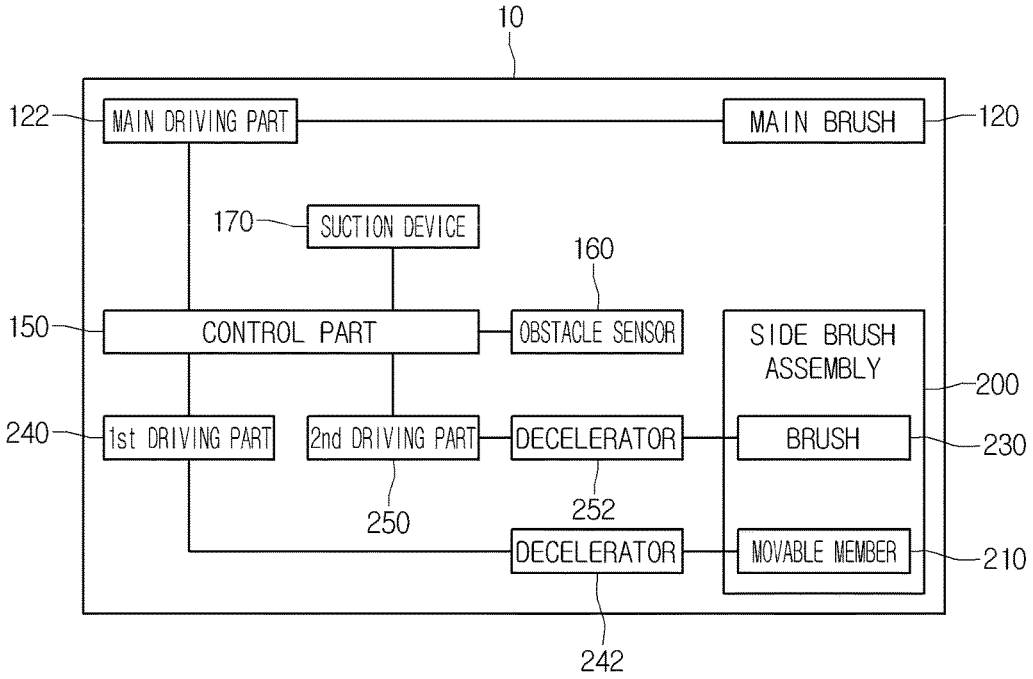
FIG. 3 is a block diagram illustrating the automatic cleaner according to the first embodiment.

FIG. 1 is a bottom view illustrating an automatic cleaner according to a first embodiment. FIG. 2 is a bottom view illustrating an operation of a side brush assembly according to the first embodiment. FIG. 3 is a block diagram illustrating the automatic cleaner according to the first embodiment.

Referring to FIGS. 1 to 3, an automatic cleaner 10 according to the first embodiment includes a casing 110 that defines an appearance of automatic cleaner 10. Casing 110 may have a flat polyhedral shape, but is not limited thereto.

Casing 110 may accommodate various components constituting automatic cleaner 10. For example, a suction device 170 for suctioning a foreign substance, and a collecting device (not shown) for collecting the suctioned foreign substance may be disposed within casing 110.

A suction port 111 is disposed in a bottom portion of casing 110. Suction port 111 functions as an inlet through which a foreign substance is suctioned into casing 110, particularly, into the collecting device by suction device 170. Suction port 111 may be formed by partially cutting the bottom portion of casing 110.

A main brush 120 is disposed inside of casing 110 on an area corresponding to suction port 111. Main brush 120 passes through suction port 111 to contact a foreign substance on a cleaning target surface (e.g., the floor) and remove the foreign substance. Main brush 120 is rotatably installed on casing 110. A main driving member 122 provides driving force for rotating main brush 120.

Casing 110 is provided with a moving device 140 for moving casing 110. Moving device 140 may include a driving motor (not shown) disposed within casing 110, and wheels rotated by the driving motor.

One or more side brush assemblies 200 are installed on the bottom of casing 110. In the first embodiment, side brush assembly 200 is provided in plurality on casing 110.

Side brush assemblies 200 are movably installed on casing 110. Side brush assembly 200 may be located underneath casing 110, or at least one portion thereof may be located underneath casing 110 and the rest thereof may be located outside the footprint of casing 110. For example, side brush assembly 200 may be rotatable with respect to casing 110.

Side brush assemblies 200 are configured such that suction device 170 suctions, through suction port 111, a foreign substance located outside the footprint of suction port 111.

Side brush assembly 200 may include: a movable member 210 rotatably connected to casing 110 through a first rotation shaft (not shown); and a brush 230 rotatably connected to movable member 210 through a second rotation shaft 233.

A portion of movable member 210 may be located inside of casing 110, and be protruded out of casing 110 according to a rotation of movable member 210. That is, movable member 210 may be rotated in a state where movable member 210 overlaps casing 110 as shown in FIG. 1, so as not to protrude outside the footprint of casing 110. When movable member 210 is rotated to protrude outside the footprint of casing 110, a vertical overlap area between movable member 210 and casing 110 is smaller than a vertical overlap before movable member 210 protrudes outside the footprint of casing 110.

In another example, movable member 210 may be entirely located outside casing 110 (at the lower side of casing 110). In this state, when movable member 210 is rotated, a portion of movable member 210 may protrude out of a side of casing 110.

When movable member 210 is disposed within casing 110, brush 230 is located outside casing 110 so that brush 230 can be rotated.

Brush 230 may include a brush holder 232 and a plurality of bristles 234 disposed on brush holder 232.

Automatic cleaner 10 may include: a first driving part 240 that generates power for rotating movable member 210; and a decelerator 242 (a transmission part) that transmits power from first driving part 240 to movable member 210. Decelerator 242 may include one or more gears, or one or more gears and a belt, but is not limited thereto.

Automatic cleaner 10 may include: a second driving part 250 for rotating brush 230; and a decelerator 252 (a transmission part) for transmitting power from second driving part 250 to brush 230. Decelerator 252 may include one or more gears, or one or more gears and a belt, but is not limited thereto. That is, brush 230 and movable member 210 may be driven by separate driving parts, respectively.

First driving part 240 may be provided on casing 110 or movable member 210. Second driving part 250 may be provided on casing 110 or movable member 210.

Decelerator 242 may be entirely provided on casing 110 or movable member 210. Alternatively, a portion of decelerator 242 may be provided on casing 110, and the rest thereof may be provided on movable member 210.

Decelerator 252 may be provided on movable member 210. Alternatively, a portion of decelerator 252 may be provided on casing 110, and the rest thereof may be provided on movable member 210.

Automatic cleaner 10 may include: a control part 150 for entirely controlling automatic cleaner 10; and an obstacle sensor 160 for sensing an obstacle. Control part 150 may control moving device 140, main driving member 122, first driving part 240, and/or second driving part 250, on the basis of information sensed by obstacle sensor 160.

Particularly, control part 150 may recognize a corner on the basis of information sensed by obstacle sensor 160, thereby controlling driving of first driving part 240.

Obstacle sensor 160 may include an infrared sensor, an ultrasonic sensor, or an optical sensor. However, the type of obstacle sensor 160 is not specifically limited, and obstacle sensor 160 may be provided in plurality. Since obstacle sensor 160 is a well-known technology, a description thereof will be omitted.

Figure 4:
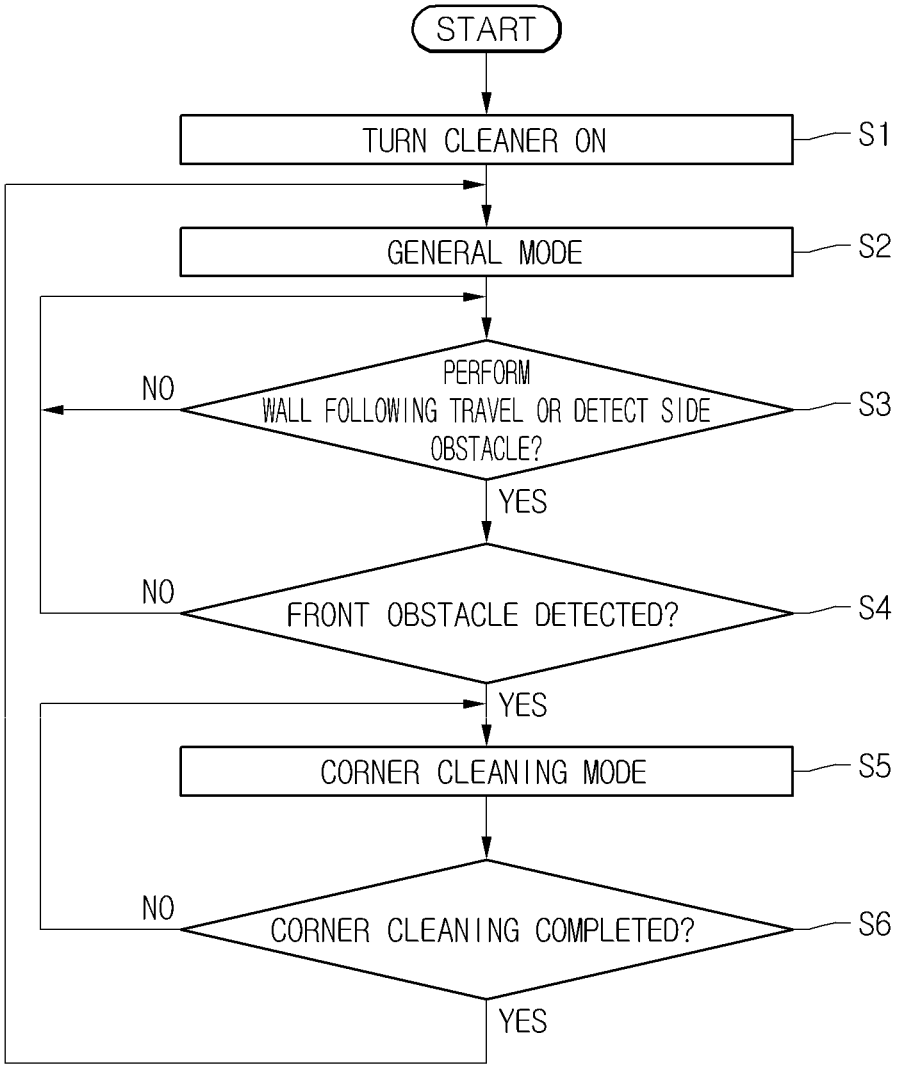
FIG. 4 is a flowchart illustrating a method of controlling the automatic cleaner according to the first embodiment.

FIG. 4 is a flowchart illustrating a method of controlling an automatic cleaner according to the first embodiment.

Referring to FIGS. 1 to 4, automatic cleaner 10 is turned on to clean a cleaning target surface (e.g., a floor) in operation S1.

In operation S2, automatic cleaner 10 may be automatically operated in a general mode or be operated in the general mode by inputting a start command. In the general mode of automatic cleaner 10, when automatic cleaner 10 is moved by moving device 140, the cleaning may be performed by main brush 120.

Second driving part 250 may be operated in the general mode to rotate brush 230 in the state where movable member 210 is stopped. Alternatively, in the general mode, first and second driving parts 240 and 250 may not be operated.

In operations S3 and S4, when automatic cleaner 10 is operated in the general mode, control part 150 determines whether a corner is recognized. Particularly, in operation S3, control part 150 determines whether automatic cleaner 10 performs wall following movement (detects a wall) or a side obstacle is detected. The wall following movement represents that automatic cleaner 10 moves along a wall.

Whether the wall following movement is performed or the side obstacle is detected may be determined on the basis of information sensed by obstacle sensor 160.

If it is determined that automatic cleaner 10 performs the wall following movement or the side obstacle is detected, control part 150 determines whether a front obstacle (or a front wall) is detected in operation S4. Since a corner generally corresponds to a region at which a plurality of surfaces (which are not limited to planes) meet each other, when a wall or side surface and a front surface are detected, control part 150 may determine that a corner is detected.

If it is determined that a corner is detected in operations S3 and S4, control part 150 controls automatic cleaner 10 to perform a corner cleaning mode in operation S5.

In the corner cleaning mode, control part 150 turns first driving part 240 on. When first driving part 240 is turned on, movable member 210 is rotated from the state of FIG. 1 (a first position) to the state of FIG. 2 (a second position). In the state where movable member 210 is rotated at a predetermined angle, first driving part 240 is turned off.

When an operation type of side brush assembly 200 (or movable member 210) in the general mode is referred to as a first operation type, an operation type (including a position and a motion pattern) of side brush assembly 200 (or movable member 210) in the corner cleaning mode may be referred to as a second operation type. In the corner cleaning mode, side brush assembly 200 is changed from the first operation type to the second operation type.

As described above, movable member 210 is not withdrawn (in the first position) in the first operation type of side brush assembly 200. Movable member 210 is withdrawn and stopped (in the second position) in the second operation type of side brush assembly 200.

When movable member 210 is rotated to protrude out of a side of casing 110 in the corner cleaning mode, brush 230 of movable member 210 is adjacent to the corner, thus effectively cleaning the corner.

In another example, in the corner cleaning mode, the second operation type of side brush assembly 200 may include repeated movements of movable member 210 between the first and second positions. That is, movable member 210 may repeatedly move between the first and second positions. In this case, an operation in which first driving part 240 is turned on to operate in a direction and is then turned off, and an operation in which first driving part 240 is turned on to operate in the opposite direction and is turned off may be sequentially repeated.

Automatic cleaner 10 may include a plurality of sensing parts to move movable member 210 from the first position to the second position and then stop movable member 210, or to move movable member 210 from the second position to the first position and then stop movable member 210. For example, the sensing parts may include: a first sensing part for sensing a movement of movable member 210 to the first position; and a second sensing part for sensing a movement of movable member 210 to the second position.

Alternatively, one sensing part may be used to sense a rotation angle of movable member 210 or the number of rotations of first driving part 240, thereby individually sensing the first and second positions.

In the corner cleaning mode, moving device 140 may be maintained in a stop state.

In operation S6, control part 150 determines whether the corner is cleaned. For example, after an operation type change time of side brush assembly 200 exceeds a reference time, or an operation type of side brush assembly 200 is changed, when the number of rotations of brush 230 (or second driving part 250) exceeds a reference number, or an operation time of second driving part 250 exceeds a reference time, or an operation type change number of side brush assembly 200 exceeds a reference number, it may be determined that the corner is cleaned.

Alternatively, whether the corner is cleaned may be determined by a sensor for detecting a cleaned state. For example, whether the corner is cleaned may be determined on the basis of a corner image captured by a camera, or be determined on the basis of an amount of dust suctioned through suction port 111 which is detected using a sensor. In the present disclosure, a method of determining whether a corner is cleaned is not specifically limited.

If it is determined that the corner is cleaned in operation S6, automatic cleaner 10 is operated again in the general mode. That is, the second operation type of side brush assembly 200 is changed to the first operation type.

Figure 5:
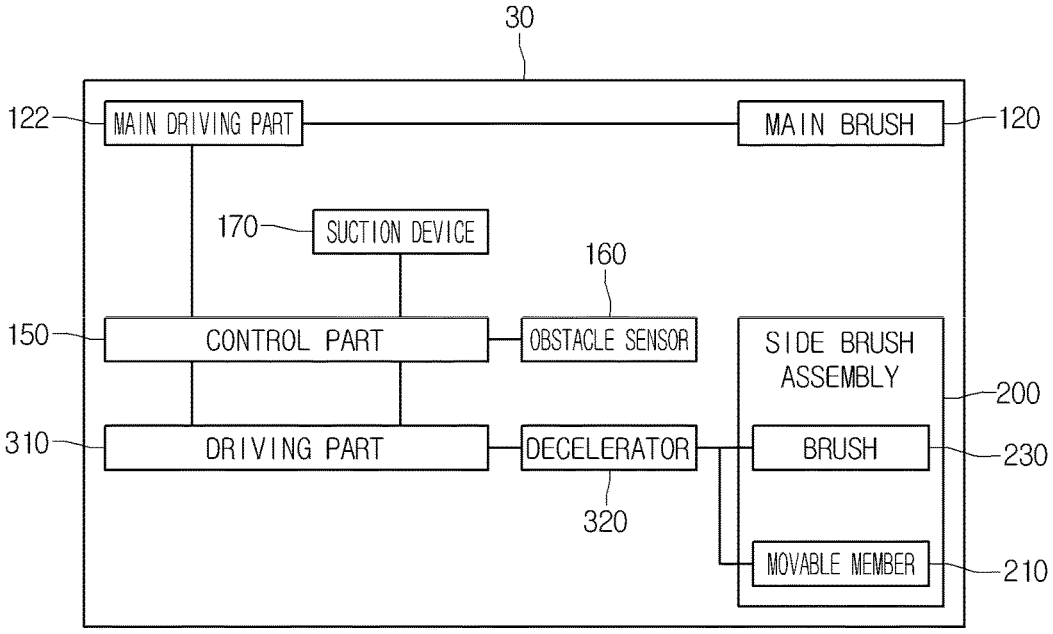
FIG. 5 is a block diagram illustrating an automatic cleaner according to a second embodiment.

FIG. 5 is a block diagram illustrating an automatic cleaner according to a second embodiment.

The second embodiment is the same as the first embodiment except for a structure for operating a side brush assembly. Thus, a characterized part according to the second embodiment will be principally described.

Referring to FIG. 5, an automatic cleaner 30 according to the second embodiment may include: a driving part 310 that generates power for operating a side brush assembly 200; and a decelerator 320 (a transmission part) that transmits the power from driving part 310 to side brush assembly 200. Decelerator 320 may individually transmit power to a movable member 210 and a brush 230.

Since driving part 310 can operate movable member 210 and brush 230, manufacturing costs of automatic cleaner 30 are decreased, and the structure thereof is simplified.

In addition, since driving part 310 can operate movable member 210 and brush 230, movable member 210 can reciprocate between the first and second positions of the first embodiment.

In a general mode, driving part 310 is not operated to maintain stop states of movable member 210 and brush 230. In a corner cleaning mode, driving part 310 is operated to rotate brush 230 and reciprocate movable member 210 in a rotary motion within in a predetermined angle range.

To reciprocate movable member 210 in a rotary motion within a predetermined angle range, decelerator 320 may include a cam and a link connected to the cam.

Figure 6:
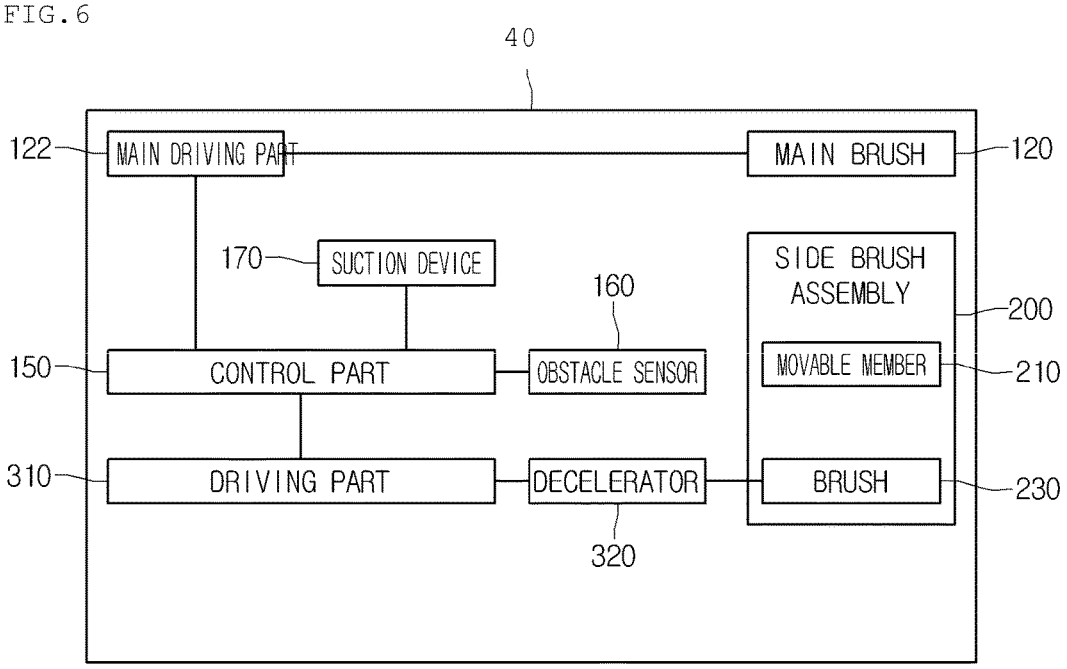
FIG. 6 is a block diagram illustrating an automatic cleaner according to a third embodiment.

FIG. 6 is a block diagram illustrating an automatic cleaner according to a third embodiment.

The third embodiment is the same as the first embodiment except for a structure for operating a side brush assembly. Thus, a characterized part according to the third embodiment will be principally described.

Referring to FIG. 6, an automatic cleaner 40 according to the third embodiment may include: a driving part 310 that generates power for operating a side brush assembly 200; and a decelerator 320 (a transmission part) that transmits power from driving part 310 to side brush assembly 200. Decelerator 320 may transmit torque to a brush 230, and transmit torque from brush 230 to movable member 210, thereby rotating movable member 210.

In a general mode, driving part 310 is not operated to maintain stop states of movable member 210 and brush 230. In a corner cleaning mode, driving part 310 is operated to rotate brush 230 and reciprocate movable member 210 in a rotary motion within in a predetermined angle range. To reciprocate movable member 210 in a rotary motion within in a predetermined angle range, decelerator 320 may include a cam and a link connected to the cam.

In another example, decelerator 320 may transmit power to movable member 210, and transmit torque from movable member 210 to brush 230.

Figure 7:
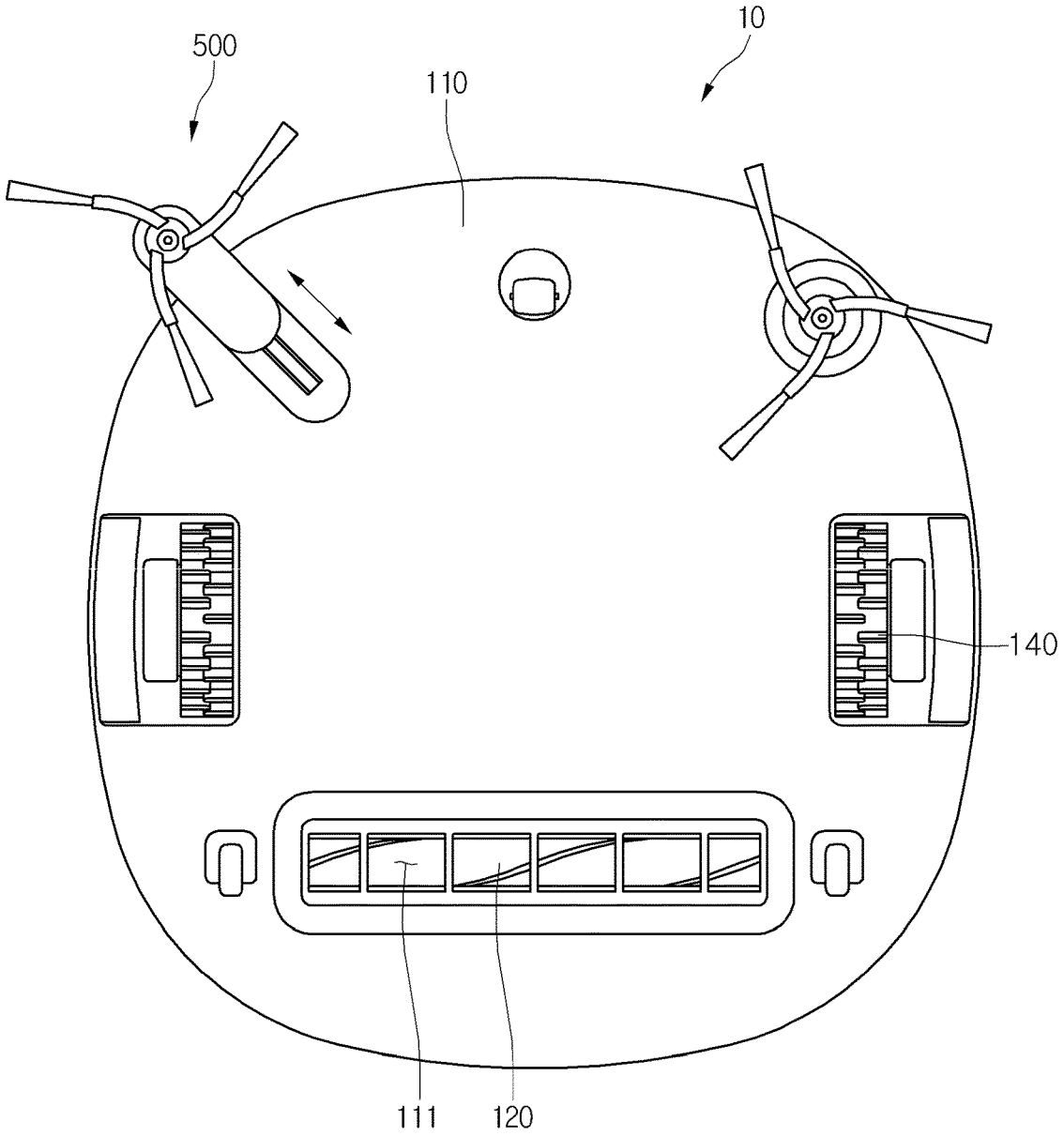
FIG. 7 is a bottom view illustrating an automatic cleaner according to a fourth embodiment.

FIG. 7 is a bottom view illustrating an automatic cleaner according to a fourth embodiment.

The fourth embodiment is the same as the first embodiment except for a structure for operating a side brush assembly. Thus, a characterized part according to the fourth embodiment will be principally described.

Referring to FIG. 7, a side brush assembly 500 according to the fourth embodiment, i.e., a movable member may be linearly movable on a casing 110. For example, side brush assembly 500 may be linearly movable on casing 110 in a diagonal direction. In other words, the movable member may be linearly movable in a direction crossing a rotation shaft of a wheel constituting a moving device 140.

When casing 110 has a circular shape, it may be difficult to efficiently clean an area located at approximately 45° about the center of casing 110. Since a corner of a cleaning region is located at approximately 45° about the center of casing 110, the movable member is moved in a line inclined at about 45° from the rotation shaft of the wheel constituting moving device 140, thereby effectively cleaning the corner. However, an angle between a moving path of the movable member and the wheel is not specifically limited.

Since the other components constituting side brush assembly 500 are the same as those of the first to fourth embodiments, a description thereof is omitted.

According to the embodiments, the operation type of the side brush assembly is changed during the cleaning of a corner to effectively clean the corner by the side brush assembly. Also, it can prevent the brush from being damaged, and the side brush assembly can be conveniently stored.

Although embodiments have been described with reference to a number of illustrative embodiments thereof, it should be understood that numerous other modifications and embodiments can be devised by those skilled in the art that will fall within the spirit and scope of the principles of this disclosure. More particularly, variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling an automatic cleaner, comprising:

moving the automatic cleaner with a side brush assembly in a first operation type;

determining a corner during a movement of the automatic cleaner based on a signal from an obstacle sensor;

changing the first operation type of the side brush assembly to a second operation type to clean the corner when the corner is determined;

determining whether the corner is cleaned; and returning the second operation type of the side brush assembly to the first operation type when the corner is cleaned, wherein the side brush assembly comprises:

a movable member movably provided in the automatic cleaner, the moveable member being connected to a casing of the automatic cleaner;

a side brush rotatably provided on the movable member by a rotation shaft;

a first drive part to move the moveable member; and a second drive part to rotatably drive the side brush, wherein the first operation type of the side brush assembly comprises maintaining the movable member fixed in a first position and rotating the side brush such that the moveable member is not moved by the first drive part and the side brush is rotatably driven by the second drive part, the second operation type of the side brush assembly comprises moving, by the first drive part, the movable member from the first position to a second position, and rotating, by the second drive part, the side brush, the movable member is protruded from the casing of the automatic cleaner while the movable member is moved by the first drive part from the first position to the second position, wherein during the cleaning of the corner, a moving device to move the automatic cleaner is maintained in a stop state and the side brush is rotatably driven by the second drive part, and wherein the automatic cleaner determines whether the corner is cleaned in a state in which the moving device is maintained in the stop state.

2. The method of claim 1, wherein the determining of the corner comprises:

determining whether a side wall or a side obstacle is sensed; and determining whether a front wall or a front obstacle is sensed.

3. The method of claim 1, wherein the determining of the corner comprises:

determining whether the automatic cleaner performs a wall following movement; and determining whether a front wall or a front obstacle is sensed, the wall following movement represents the automatic cleaner moving along a wall.

4. The method of claim 1, wherein the determining of whether the corner is cleaned comprises at least one of:

determining when a time of changing an operation of the side brush assembly exceeds a reference time, determining when a number of rotations of the side brush exceeds a reference number after an operation type of the side brush assembly is changed, determining when an operation time of the second drive part that drives the side brush exceeds a reference time, or determining when a number of changing an operation of the side brush assembly exceeds a reference number.

5. The method of claim 1, wherein in the determining of whether the corner is cleaned, a camera captures a corner image, or a sensor senses an amount of dust suctioned through a suction port.

6. The method of claim 1, wherein the movable member rotates or linearly moves to change the side brush assembly from the first operation type to the second operation type.

7. The method of claim 6, wherein an overlap area between the movable member and the casing when the side brush assembly is in the second operation type is smaller than an overlap area between the movable member and the casing when the side brush assembly is in the first operation type.

8. A method of controlling an automatic cleaner, comprising:

moving the automatic cleaner with a side brush assembly in a general mode;

determining a corner during a movement of the automatic cleaner based on a signal from an obstacle sensor;

operating a side brush assembly in a corner cleaning mode when the corner is determined; and determining whether the corner is cleaned, wherein the side brush assembly comprises:

a movable member movably provided on the automatic cleaner, the moveable member being connected to a casing of the automatic cleaner;

a side brush rotatably connected to the movable member by a rotation shaft;

a first drive part to move the moveable member; and a second drive part to rotatably drive the side brush, wherein the movable member is in a first operation type in the general mode, and is changed to a second operation type in the corner cleaning mode, the side brush is rotated in both the general mode and the corner cleaning mode, the movable member is protruded from the casing of the automatic cleaner while the movable member is moved by the first drive part from a first position to a second position, wherein during the cleaning of the corner, a moving device to move the automatic cleaner is maintained in a stop state and the side brush is rotatably driven by the second drive part, and, wherein the automatic cleaner determines whether the corner is cleaned in a state in which the moving device is maintained in a stop state, wherein the determining of whether the corner is cleaned comprises at least one of:

determining when a time of changing an operation of the side brush assembly exceeds a reference time, determining when a number of rotations of the side brush exceeds a reference number after an operation type of the side brush assembly is changed, determining when an operation time of the second drive part that drives the side brush exceeds a reference time, or determining when a number of changing an operation type of the side brush assembly exceeds a reference number.

9. The method of claim 8, wherein the determining of the corner comprises:

determining whether a side wall or a side obstacle is sensed; and determining whether a front wall or a front obstacle is sensed.

10. The method of claim 8, wherein the determining of the corner comprises:

determining whether the automatic cleaner performs a wall following movement; and determining whether a front wall or a front obstacle is sensed, the wall following movement represents the automatic cleaner moving along a wall.

11. The method of claim 8, wherein in the determining of whether the corner is cleaned, a camera captures a corner image, or a sensor senses an amount of dust suctioned through a suction port.

* * * * *